US005320691A

United States Patent [19]

Weber

[11] Patent Number: 5,320,691

[45] Date of Patent: Jun. 14, 1994

[54] CHARCOAL-FREE BLACK POWDER TYPE GRANULES AND METHOD OF PRODUCTION

[75] Inventor: Anton B. Weber, Montclair, N.J.

[73] Assignee: The United States of America as represented by the Secretary of the Army, Washington, D.C.

[21] Appl. No.: 94,411

[22] Filed: Jul. 3, 1993

[51] Int. Cl.[5] ..... C06B 31/02; C06B 21/00

[52] U.S. Cl. ..... 149/61; 264/3.5; 264/3.6

[58] Field of Search ..... 149/61; 269/3.5, 3.6

[56] References Cited

U.S. PATENT DOCUMENTS

| | | | |
|---|---|---|---|
| 3,702,353 | 11/1972 | Henderson et al. | 264/3 D |
| 4,032,375 | 6/1977 | Wasson | 149/41 |
| 4,358,327 | 11/1982 | Reed, Jr. et al. | 149/19.4 |
| 4,436,525 | 3/1984 | Zmoda et al. | 44/266 |
| 4,547,235 | 10/1985 | Schneiter et al. | 149/35 |

OTHER PUBLICATIONS

Selzer et al., U.S.S.I.R. #H705, Nov. 7, 1989.

*Primary Examiner*—Peter A. Nelson

*Attorney, Agent, or Firm*—Anthony T. Lane; Edward Goldberg; Michael C. Sachs

[57] ABSTRACT

A method of producing an energetic composition comprising the steps of (a) dissolving an alkali metal hydroxide in aqueous denatured alcohol to form an alcohol and alkali metal hydroxide solution; (b) kneading phenolphthalein or other reaction product of a phenolic compound and phthalic anhydride with sulfur, potassium nitrate and said alkali metal hydroxide solution formed in step (a); (c) allowing the kneaded product formed in step (b) to dry through evaporation of the aqueous denatured alcohol; (d) granulating the dried product formed in step (c); and (e) further drying the granulated product formed in step (d). An alternate method is also disclosed in which an alkali metal salt of phenolphthalein is used so as to avoid use of the alkali metal hydroxide in the aqueous denatured alcohol. Granular products are disclosed and closed bomb test results are presented. Certain products match the performance of commercial black powder.

26 Claims, 4 Drawing Sheets

CHARCOAL-FREE BLACK POWDER TYPE GRANULES AND METHOD OF PRODUCTION

BACKGROUND OF THE INVENTION

This invention relates to explosive, propellant and pyrotechnic compositions and more particularly to charcoal-free substitutes for black powder and methods of manufacture thereof.

Black powder is a low explosive composition of potassium nitrate or sodium nitrate, charcoal and sulfur. Black powder is unpredictable in a sense that it can ignite unexpectedly and thereby cause property destruction, injuries, and death. The unpredictability of black powder originates from the variability of the charcoal constituent, which makes up 15% of the black powder composition. Charcoal is produced by carbonization of wood, a natural product that has physical and chemical properties depending on the tree species, soil composition, and environmental conditions. Due to the inherent variability of wood and fluctuations in the carbonization process, the properties of charcoal, such as its composition, ash content, pore structure, density and percent volatiles, vary from batch to batch and cause variations in the black powder performance. Certain crystalline organic compounds to replace charcoal in black powder were suggested by Wise and Sasse in U.S. Statutory Invention Registration No. H72 of Jun. 3, 1986, which is herewith incorporated by reference. The object of the instant invention is to substantially reduce variations in performance by eliminating charcoal from the black powder composition and replacing it with an effective synthetic material.

SUMMARY OF THE INVENTION

The method of the present invention provides for a series of explosive, propellant and pyrotechnic materials (which will hereafter be collectively referred to as "energetic compositions") which are dispersions of unconverted phenolphthalein, potassium nitrate and sulfur in a binding phase of phenolphthalein salt. The performance of said new products in closed bomb tests, namely their burn time and pressure development rate, can be controlled with the percent phenolphthalein salt in the product; and with the cation of the phenolphthalein salt. Cations from the group consisting of sodium, potassium, lithium, and ammonium, were prepared and tested. The closed bomb performance of commercial black powder was duplicated by certain of said products.

One advantage of the invention is that said products can be prepared by following a simple method comprising:

(a) dissolving an alkali metal hydroxide in a solvent selected from the group consisting of water, ethanol, denaturated alcohol and mixtures thereof;

(b) kneading a reaction product of phthalic anhydride and a phenolic compound which is preferably phenolphthalein, sulfur and potassium nitrate or sodium nitrate with said solvent;

(c) allowing the kneaded product to sufficiently dry through evaporation of said solvent;

(d) granulating the sufficiently dry product; and (e) further drying the granules to remove solvent.

It would, alternatively, also be possible to use a alkali metal salt of the phenolphthalein or other phenolic derivative compound and thereby avoid dissolving the alkali metal hydroxide in the solvent.

For the purpose of this disclosure, "phenolic compounds" are considered to be compounds of the general formula ArOH where Ar is phenyl, a substituted phenyl or other aryl. Such phenolic compounds include, but are not limited to phenol, cresols, catechol, resorcinol, hydroquinone, hydroxybenzoic acids and salicylic acid. For the purpose of this disclosure, "denatured alcohol" is considered to be ethanol mixed with minor portions of other alcohols and/or water.

Another advantage of the invention is that the process is adaptable to existing commercial scale mixmuller facilities in ammunition plants and that no capital investment would be required should the products be needed in large quantities.

A new result is that the products of the invention are agglomerates of phenolphthalein or other phenolic derivative compound, potassium nitrate and sulfur particles bound with phenolphthalein or other phenolic derivative. The large contact area between said salt and the agglomerated particles increases the product's burn rate and pressure development rate in closed bomb tests.

An advantage of a preferred embodiment of the method of the present invention is the use of phenolphthalein because it is non-toxic, relatively cheap and guaranteed available through the precursors phthalic anhydride and phenol, which are bulk petrochemicals.

Another process advantage stems from the solubility of the phenolphthalein salts (sodium, potassium, lithium, ammonium salts and their mixtures) in ethanol. This solubility in ethanol is exploited in the invention by enabling the coating of potassium nitrate and sulfur with the phenolphthalein salt. The potassium salt of phenolphthalein is preferred above the other salts because it has the same cation as potassium nitrate. This keeps the number of moieties in the composition low. In addition, the potassium salt is less hygroscopic than the sodium or lithium salts.

Another advantage of the invention is that the pyrotechnic performance of the products can be controlled with the ratio of potassium hydroxide to phenolphthalein, i.e. the percent phenolphthalein salt. Products with a molar ratio of ranging from about zero to about two were prepared and tested.

The use of ethanol as the mixing medium is also advantageous because it is commonly used as a mixing medium in ammunition plants.

A preferred solvent is aqueous ethanol, containing from about 1% to about 10% water because: (1) the presence of moisture reduces static electricity hazards during mixing; and (2) the solubility of potassium hydroxide is higher in aqueous ethanol than in ethanol.

A process result is that the granules produced in step (d) of said process have a higher concentration of phenolphthalein salt at the granule surface than within the granule. This results from migration of phenolphthalein salt solution to the surface during drying in Step (e).

Whereas binders can be used to improve the bonding between potassium nitrate, sulfur and phenolphthalein salt (for example ethanol-soluble binders, such as vinyl alcohol acetate resins and polyvinyl alcohol resins), a great advantage of the instant invention is that the soluble phenolphthalein salt itself functions as a binder.

Summarizing, the instant invention offers the following advantages relative to the prior art:

1. The burn time and pressure development rate of the products can be controlled with the amount of phenolphthalein salt in the composition.
2. The products burn cleaner and generate less smoke and residue than black powder.
3. The laboratory kneading process resembles mix-mulling and can be scaled up to existing mix-muller facilities in ammunition plants.
4. The granular products are free-flowing which facilitates their processing into end-items.

Further objects and advantages of the invention are apparent from the description presented below.

DESCRIPTION OF THE PREFERRED EMBODIMENTS

An understanding of the method, products and objects of the invention will be readily attained by those versed in the art from a consideration of the description of the best mode of the invention and the examples presented below, which are given by way of illustration and not as limitations on the scope of this invention. In the examples reference is made to the accompanying drawings in which.

MATERIALS USED

Figure 1:
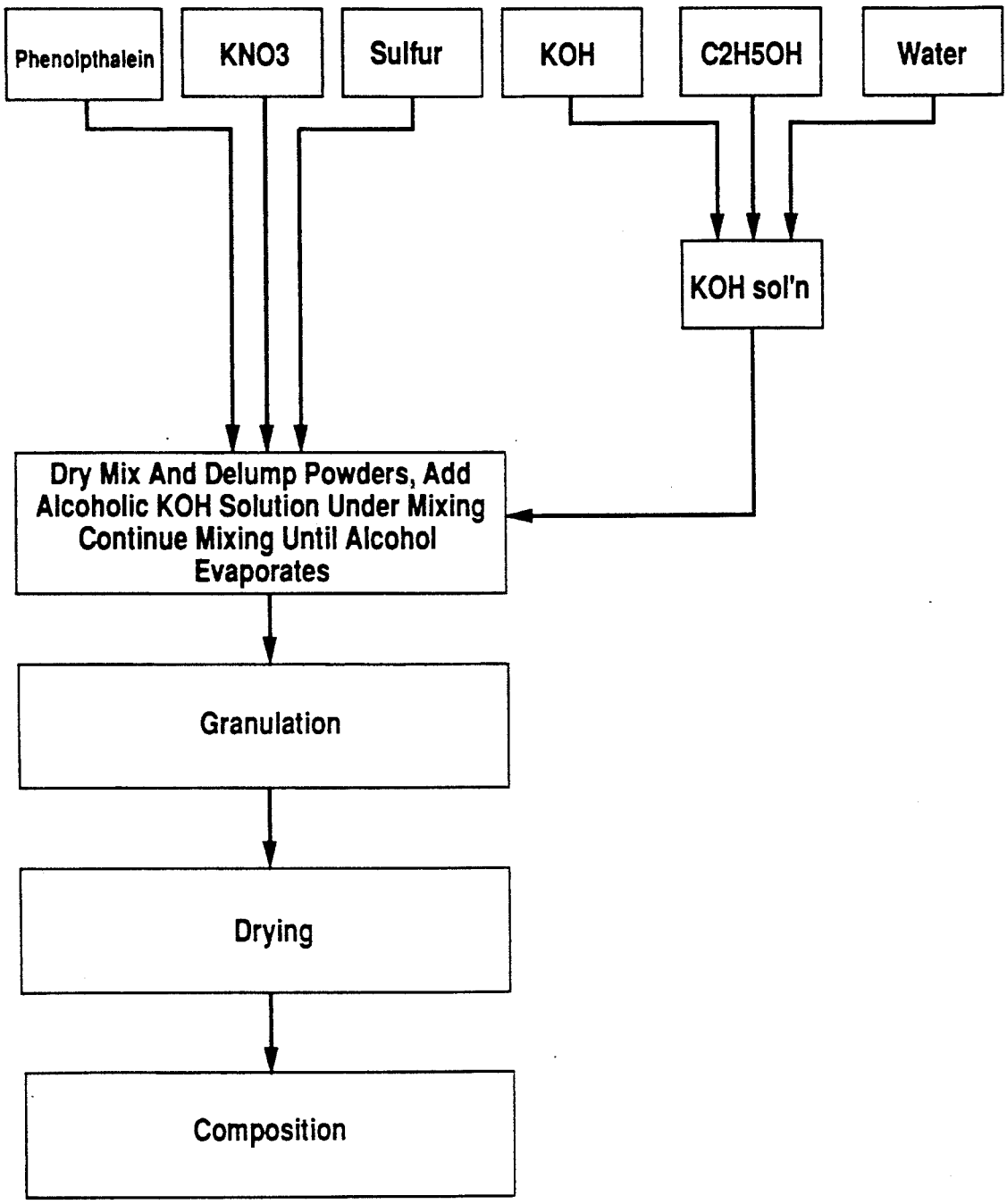
FIG. 1 is a block diagram for the production of granular charcoal-free black powder type composition according to a preferred mode of the invention.

The specifications for the materials and chemicals referred to herein in describing the method and composition of the present invention are listed below:

1. Phenolphthalein: Powder, U.S.P. or equivalent. Products of less purity can be used.
2. Sulfur: Ground, Grade C Military Specification: MIL-S-487B or equivalent.
3. Potassium nitrate: Class C Military Specification: MIL-P-156B or equivalent.
4. Ethanol 90/10: Prepared by mixing 90 parts of ethanol with 10 parts of distilled water. Denaturated alcohol may be used instead of ethanol.
5. Potassium hydroxide: Pellets, U.S.P. or equivalent.
6. Sodium hydroxide: Pellets, U.S.P. or equivalent.
7. Lithium hydroxide: Pellets, U.S.P. or equivalent.
8. VAAR Tradename for vinyl acetate-vinyl alcohol resins. Solution No. MA-28-18, containing 28% solids in methyl acetate-methanol solvent, was used. Manufacturer: Union Carbide Corporation, New York City, N.Y.
9. PVA Resin Vinyl acetate polymer. Product identification: AYAA. Manufacturer: Union Carbide Chemicals & Plastics Company Inc. Address: P.O. Box 38001, South Charleston, W. Va. 25303-3801
10. DUREZ Tradename for phenolic resins. Product identification: DUREZ #30934. Manufacturer: Occidental Chemical Company, DUREZ Division, Tonawanda, N.Y.
11. VITON Tradename for fluorinated synthetic rubber. Manufacturer: E. I. DUPONT de NEMOURS & CO, Wilmington, Del.
12. VITON A Tradename for vinylidene fluoride-hexafluoropropylene. Manufacturer: E. I. DUPONT de NEMOURS & CO, Wilmington, Del.
13. BLACK POWDER, GOEX, CLASS V (−16+40 mesh) Military Specification: MIL-P-223 Supplier: GOEX Corporation, Moosic, Pa.
14. BLACK POWDER, GOEX, CLASS III (−8+16 mesh) Military Specification: MIL-P-223 Supplier: GOEX Corporation, Moosic, Pa.
15. BLACK POWDER, CIL, CLASS I (−4+8 mesh) Military Specification: MIL-P-223 Supplier: CIL, Canadian Industries Limited.
16. AMMONIUM HYDROXIDE: Technical, 27.0–30.0% $NH_3$ Supplier: J. T. Baker, Phillipsburg, N.J.

METHODS OF PREPARATION

These general variations of the method of the present invention are described as follows:

Process A

The general procedure for preparing charcoal-free black powder type granular products is conducted in a open mixing dish at atmospheric pressure. The procedure comprises the steps of:

1. Adding weighed amounts of powdered phenolphthalein, potassium nitrate and sulfur to a porcelain mortar and pestle;
2. Mixing the powder mixture with the pestle and crush lumps if present;
3. Adding a sufficient volume of a potassium hydroxide solution in anhydrous ethanol to the powder mixture to obtain a fluid dispersion;
4. Adding a solution of a binder in ethanol, as a process option;
5. Continuing to mix with the pestle and allowing ethanol to evaporate until the dispersion turns into firm moist lumps.
6. Placing the lumps on a sieve and pressing the lumps through the sieve openings with, for example, a rubber stopper; and
7. Drying the moist granules in an oven for minimum 4 hours at 60° C.

A free flowing dark violet product is obtained.

The time required to evaporate a sufficient quantity of ethanol from the dispersion until firm moist lumps are formed is somewhat empirical but can be readily determined by the skilled artisan for a particular batch.

Process B

The salts of phenolphthalein are prepared separately by reacting phenolphthalein with a solution of alkali hydroxide in deionized water. The solution is dried and the residue is ground and screened to pass 200 mesh. The steps of Process A are modified as follows:

1. Adding potassium nitrate, sulfur and phenolphthalein salt to a porcelain dish and mix with a pestle;
2. Adding sufficient anhydrous ethanol to the powder mixture to form a slurry;

Steps (5) to (7) from Process A remain the same.

Process C

The general procedure of Process A for preparation of charcoal-free black powder type granular products is followed, except (1) that optional binders are omitted; and (2) the mixing medium is changed from 100% ethanol to ethanol containing 10% wt. water. For many applications, this method is the preferred embodiment.

Figure 2:
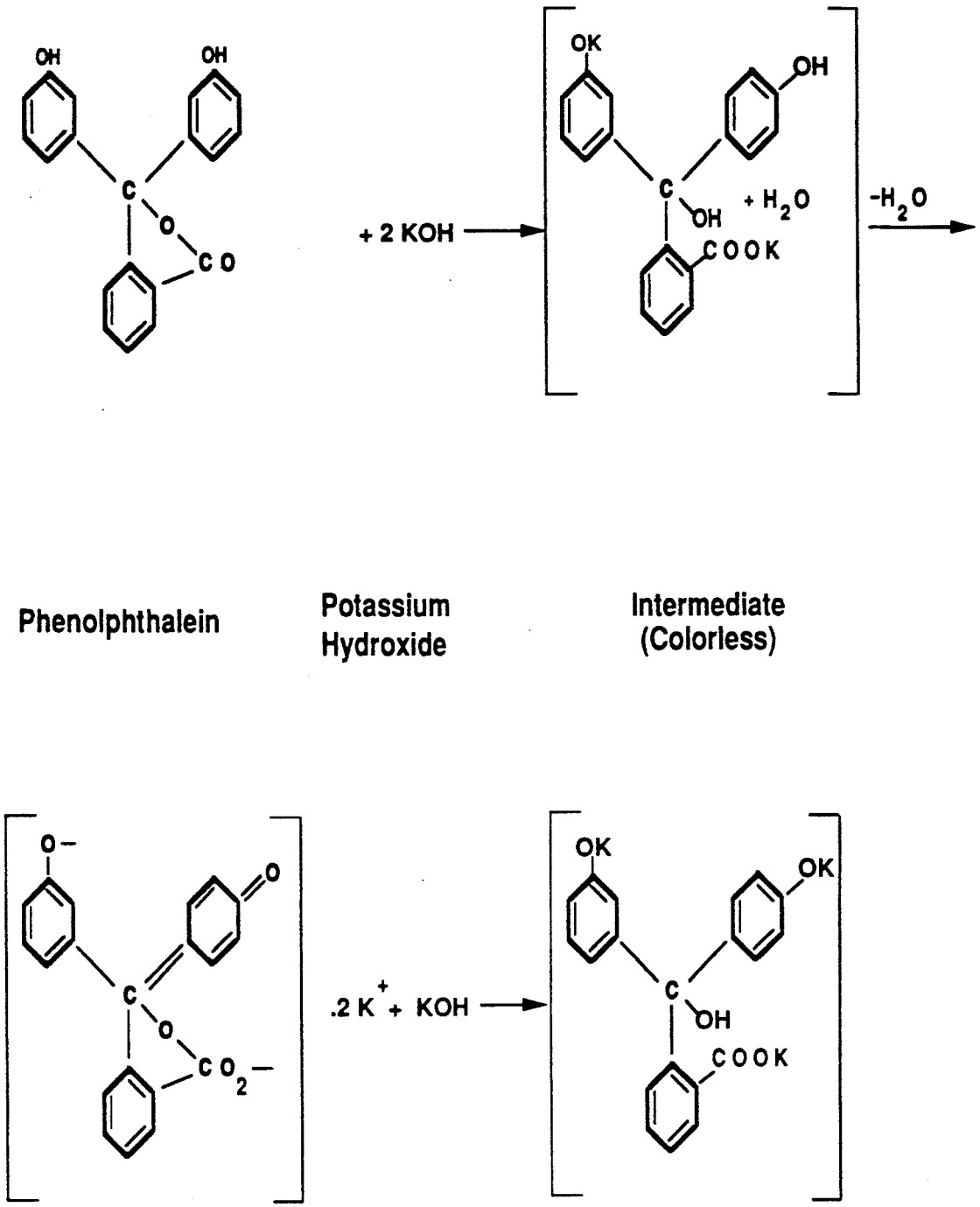
FIG. 2 shows the chemical reactions between phenolphthalein and potassium hydroxide during the mixing cycle.

In processes (a), (b) and (c) it is found that phenolphthalein reacts almost instantaneously with the alcoholic potassium hydroxide solution under formation of a red soluble salt. These chemical reactions are shown in FIG. 2.

The potassium salt is a preferred phenolphthalein salt because the number of moieties in the composition remain the lowest because potassium hydroxide and potassium nitrate have the same cation. Also, the potassium salt of phenolphthalein is less hygroscopic than the sodium or lithium salts.

Ethanol is a preferred mixing medium because ethanol dissolves phenolphthalein salts from the group IA alkali metal hydroxides (potassium, sodium, lithium, rubidium, cesium and francium) and ammonium hydroxide. Ethanol is also a common mixing medium used in ammunition plants and is relatively safe for mixing oxidizers with fuels. Further, ethanol is relatively nontoxic and has a suitable boiling point, evaporation rate and flash point. Aqueous ethanol, containing a few percent of water, is an even more preferred mixing medium because: (1) it dissolves more potassium hydroxide per unit weight; and (2) the water in the ethanol increases the conductivity of the reaction mixture thereby rendering the grounding of equipment more effective and reducing the risks of build-up of electrostatic charges during mixing.

In a preferred mode of the invention, aqueous ethanol consisting of 10 parts of water and 90 parts of ethanol, is used. It is expected that ethanol-water mixtures with a water content from about 2% to about 30% wt. water will also be suitable. It is also expected that denaturated ethanol can be used in lieu of pure ethanol.

In one postulated process mechanism, the phenolphthalein salt solution coats phenolphthalein, potassium nitrate and sulfur particles during the mixing step of the process, and forms a binding phase of phenolphthalein salt when the slurry dries. As a result of this mechanism, the phenolphthalein salt functions as a binder and holds together the sulfur, potassium nitrate and phenolphthalein salt in the granule.

In another postulated process mechanism the surface of moist granules dries first and sorps solution from within the granule to the surface. The sorped solution dries at the surface and causes additional quantities of phenolphthalein salt to deposit at the granule surface. This solution transfer continues until the granule is dry. As can be concluded from closed bomb test results presented below, the surface characteristics of the granules improve the burn rate and pressure development rate, but this improved performance is lost when the granules are crushed and ground.

TESTING OF THE PRODUCTS IN A CLOSED BOMB

Closed bomb tests were conducted with samples of the charcoal-free pyrotechnic products described in the examples. Commercial black powder was tested as a baseline.

The test equipment consisted of a 50 ml stainless steel bomb (Parr Instruments Company). The bomb head was fitted with a Kistler pressure transducer, model #211B2. A resistance wire mounted to within the bomb was connected to a 15 Volt AC source. Time pressure data were collected on a NICOLET 4094C digital oscilloscope. Data reduction was performed on a HEWLETT PACKARD 98216 computer. The test procedure includes the steps of:

1. weighing 2.000 grams of the sample in a copper plumbing cap of ¾ inch diameter;
2. placing the cap in the bomb;
3. looping a 24 gauge nickel-chrome resistance wire through the pyrotechnic sample in the cap;
4. closing the bomb;
5. igniting the sample by passing a current through the resistance wire from a 14 Volt AC source;
6. collecting and storing test data on a Nicolet 4094 digital oscilloscope;
7. determining the rise time (dt) by taking the time at 50 psi, up to the time at which the pressure attained a value of 50 psi less than the peak pressure; and
8. determining the pressure development rate (dp/dt) as the slope bound by the rise time.

BURN RATE TESTING

Figure 3:
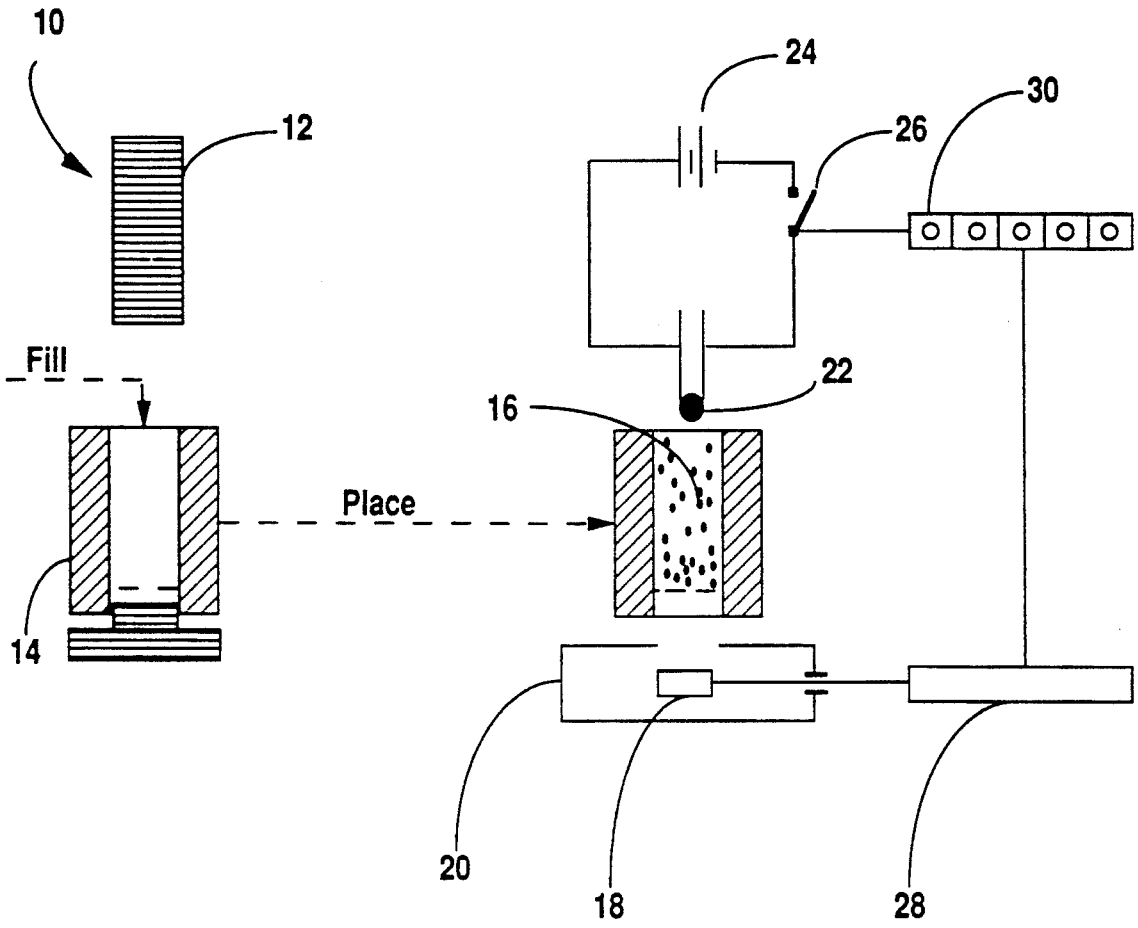
FIG. 3 depicts the apparatus for measuring the burn time of consolidated products in fuze housings.
Figure 4:
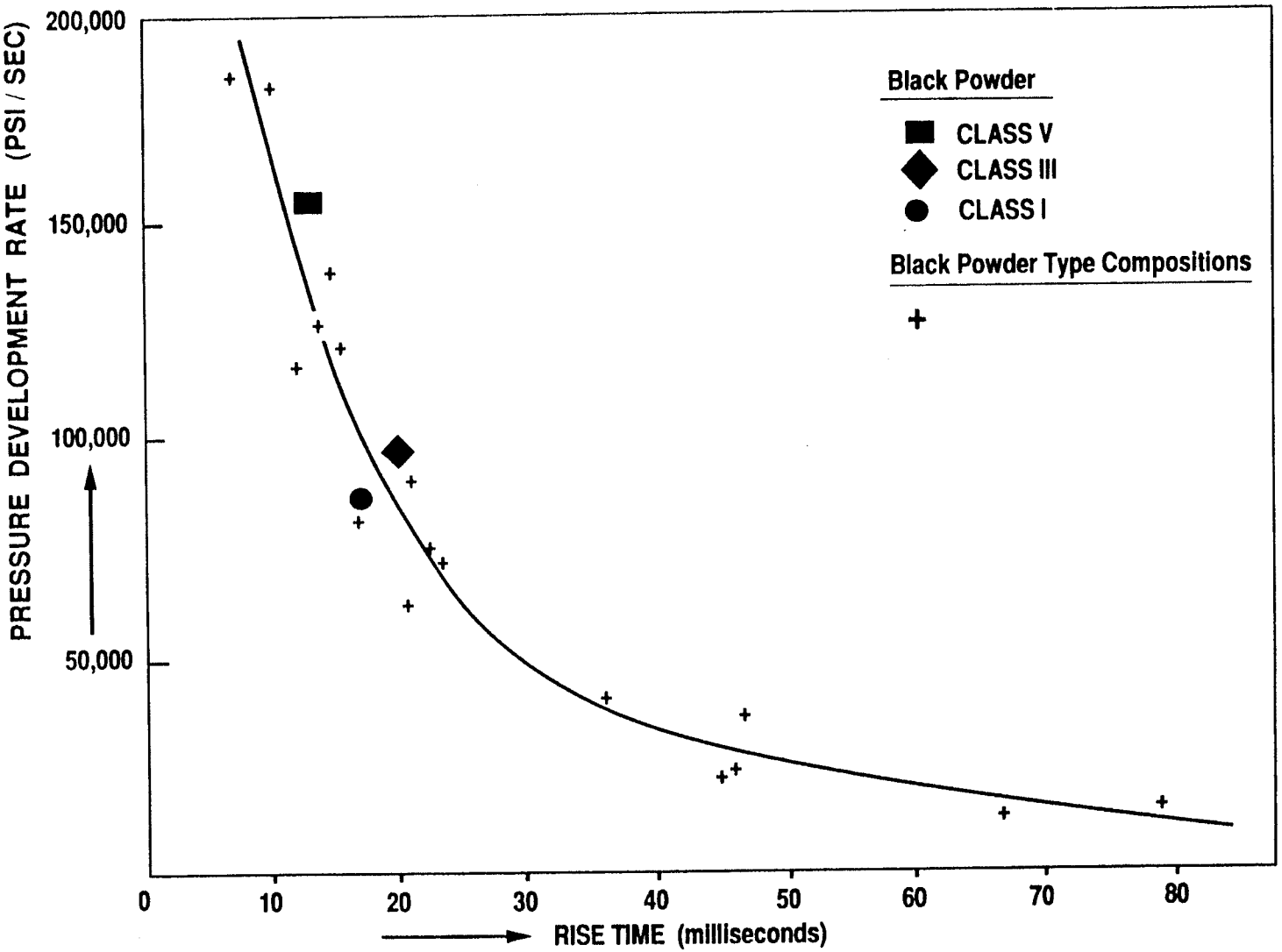
FIG. 4 is a graph showing the rise time vs. pressure development in closed bomb tests from the data set forth in Table I.

The burn time of consolidated granules was measured after consolidating the compositions at 10,000 psi in brass fuze housings. Commercial black powder was also tested in the same housings as a reference. The test equipment is shown in FIG. 3. in which a press is shown generally at numeral 10. This press consists of a punch 12 and an anvil 14 which has a cylindrically shaped cavity having a length a 0.79 inch and a diameter of 0.25 inch. The equipment also includes a M-112 fuze housing 16 which is positioned above a photovoltaic cell 18 which has an enclosure 20. Positioned in contact with consolidated material in the fuze housing is an electric match 22 which is in circuit with a 12 Volt EVEREADY No. 732 battery 24 and switch 26. The photovoltaic cell is in circuit with signal converter 28 and electronic counter 30. The steps of the testing procedure are that the fuze housing is filled with 1.05 grams total in four equal increments. The material is consolidated after each increment with the press. The switch is then closed to simultaneously ignite the electric match to and start the electronic counter. When the burn front reaches the bottom of the fuze housing, the photocell senses the emission of light and shuts off electronic counter a reading of the burn time on counter 12 is then taken.

EXAMPLE I (Process A)

This example illustrates the preparation of a charcoal-free powder type granular product from sodium hydroxide, phenolphthalein, potassium nitrate, sulfur and VAAR as binder. Ethanol is the mixing medium.

Preparation

In a first step, phenolphthalein (2.6 grams), potassium nitrate (15.0 grams), and sulfur (2.0 grams) are added to a porcelain mortar of 3.5 inch diameter by 2 inches depth. The powders are mixed for approximately three minutes with a porcelain pestle. Lumps in the powder mixture are crushed. Next, a solution of sodium hydroxide in ethanol (8.25 grams of solution containing 0.62 grams of sodium hydroxide) is added to the mortar under mixing. During continued mixing, ethanol evaporates gradually from the mixture until soft lumps form. Next, 2.4 grams of a VAAR solution containing 0.24 gram solids, is added to the mortar and is mixed with the lumps in the mortar. Mixing and evaporation of ethanol is continued until firm lumps are formed.

In a second step, the lumps from step one are placed on a stainless steel No. 16 ASTM sieve of eight inch diameter. The sieve is positioned above a sieve pan of same diameter. The lumps are pressed through the sieve openings with a black rubber stopper. The particles that pass the screen openings collect in the sieve pan.

In a third and final step, the moist granules are dried overnight at room temperature. A free-flowing violet colored product is obtained.

Test Results

The product obtained by Example I is identified as No. 221. The calculated composition and closed bomb test results of No. 221 are shown in Table I.

Table II shows the burn time of consolidated No. 221.

CONCLUSIONS

Consolidated No. 221 has an unremarkable burn time (3.44 seconds) relative to the series tested.

Granular No. 221, tested in a closed bomb, is one of the least energetic in the series tested. It has a relatively long rise time (66 milliseconds) and relatively low pressure development rate (15,900 psi/sec).

During the preparation of No. 221, it appeared that the moist lumps before granulation were hard and difficult to work through the openings of the sieve, probably as a result of the 1.2% VAAR content. Subsequent compositions were made at lower than 1.0% VAAR.

EXAMPLE II (Process A)

In this example, a charcoal-free black powder type granular product is prepared following the procedure of Example I, except that potassium hydroxide is used instead of sodium hydroxide.

The binder content (VAAR) is reduced from the 1.2% by weight used in Example I to 0.4% by weight.

Preparation

In a first step, phenolphthalein (5.7 grams), potassium nitrate (26.8 grams), and sulfur (4.2 grams) are added to a porcelain dish of seven inch diameter. The powders are pulverized and mixed for a period of approximately three minutes using a porcelain pestle. Lumps, if noticed in the mixture, are crushed. The resulting powder is brushed through the openings of a No. 200 ASTM sieve. The +200 mesh oversized particles are reground and rescreened until the total mixture is below 200 mesh.

In a second step, the - 200 mesh powder mixture is returned to the porcelain dish and a solution of potassium hydroxide in ethanol (17.5 grams of solution containing 1.79 grams of potassium hydroxide) is added to the powder mixture. The resulting slurry is thoroughly mixed with the pestle. Ethanol evaporates more rapidly in this procedure because in the larger dish more product is exposed to the atmosphere per unit time. The mixing is stopped at the point when the fluid dispersion turns into soft lumps. Then, a solution of VAAR (vinyl alcohol acetate resin; 1.5 grams of solution containing 0.15 gram solids) is added to the mortar and mixed with the lumps. Mixing and evaporation of ethanol continues until firm lumps are formed.

In a third step, the lumps from the second step are pressed through the openings of a stainless steel No. 12 ASTM sieve of eight inch diameter using a rubber stopper. The sieve is placed above a sieve pan wherein the moist granules collect.

In a fourth step, the moist granules are dried overnight at room temperature. A free-flowing violet colored product is obtained.

Test results

The product obtained by Example II is identified as No. 222. The calculated composition and closed bomb test results of product 222 are shown in Table I.

Table II shows the burn time of consolidated product 222.

Consolidated No. 222 has a burn rate of 3.75 seconds which is comparable to most of the compositions made and, thus, not outstanding in any way.

On the other hand granular No. 222 performs superiorly in the closed bomb test with results of 10.3 milliseconds rise time and 178,000 psi/sec. pressure development rate.

In an additional test it was demonstrated that the constitution of the external area of the granules is critical for their performance. The test involved pulverizing granular No. 222 in a mortar and brushing the resulting powder through a No. 35 ASTM sieve. The burn rate and pressure development rate of ground No. 222 were significantly changed to 21.8 milliseconds and 89,200 psi/sec. respectively.

Also included in Table I are results for Class V and Class I black powder, tested as is and after pulverizing and screening to a particle size below 35 mesh. As expected, the finer black powder burns faster and develops a higher pressure development rate in closed bomb tests. These results prove that there are no critical surface characteristics in black powder.

EXAMPLE III (Process A)

In this example, a charcoal-free black powder type granular product is prepared following the procedure as described in Example I, except that 1% of DUREZ 30934 is used as a binder in place of VAAR.

Preparation

In a first step, phenolphthalein (3.906 grams) is added to a porcelain mortar of 3.5 inch diameter by 2 inch depth. A solution of sodium hydroxide in ethanol (35.6 grams of solution containing 0.932 gram of sodium hydroxide) is added to the phenolphthalein powder and the resulting slurry is thoroughly mixed using the porcelain pestle. Next, potassium nitrate (23.99 grams), and sulfur (3.016 grams) are added to the mortar and mixed with the slurry. Mixing continues while ethanol evaporates from the mixture. After soft lumps are formed, an ethanol solution of DUREZ, 3.468 grams of solution containing 0.321 gram DUREZ, is added to the mortar and mixed with the lumps. Mixing and evaporation of ethanol continues until the dispersion turns into lumps.

In a second step, the lumps from the first step, are placed on a stainless steel No. 16 ASTM sieve of eight inch diameter positioned above a sieve pan. The lumps are pressed through the sieve openings using a black rubber stopper. The granules collect in the pan.

In a third step the moist granules are dried overnight at room temperature. A free-flowing violet colored product is obtained.

Test Results

The product obtained in Example III is identified as No. 239. The calculated composition and closed bomb test results of No. 239 are shown in Table I.

Table II shows the burn time of consolidated No. 239.

Conclusions

Consolidated No. 239 has a burn rate of 3.45 seconds which is in the same order of magnitude as most of the compositions.

Granular No. 239 performs less energetic than No. 222 in the closed bomb test (14.0 milliseconds rise time and 126,000 psi/sec. pressure development rate). The same pulverizing/screening test was conducted to check the closed bomb performance of powdered No. 239. The burn rate and pressure development rate of ground No. 239 changed to 35.3 milliseconds and 42,300 psi/sec. This result is another confirmation that surface characteristics of the original granules are essential for their good energetic performance.

EXAMPLE IV (Process B)

In this example, a charcoal-free black powder type granular product is prepared following the procedure in Example I, except that ammonium hydroxide is used instead of sodium hydroxide.

Preparation

In a first step, powdered raw materials are prepared: phenolphthalein (10.4 grams) and ethanol (50 grams) are added to a glass beaker and stirred. Next, aqua ammonia (29% $NH_3$; 4.8 grams total) is added to the suspension under stirring. The phenolphthalein dissolves rapidly under formation of a pinkcolored solution. After 30 minutes mixing, the solution is poured into a stainless steel sieve pan of eight inch diameter and the solution in the pan is dried overnight at ambient conditions. Next, the residue is dried for 30 minutes at 110° C. in the pan and thereafter ground in a mortar. The ground product is brushed through a No. 200 ASTM sieve. The other two raw materials, potassium nitrate and sulfur, are also ground and brushed through the 200 mesh sieve before use.

In a second step, the three powders from step I are added to the mortar of 3.5 inch diameter by 2 inch depth and are mixed with a VAAR solution (2.4 grams containing 0.24 gram solids). Mixing is continued and ethanol is allowed to evaporate from the mixture until the solution turned into soft lumps.

In a third step, the lumps from the second step are placed on a stainless steel No. 16 ASTM sieve of eight inch diameter fitted on a sieve pan of same diameter. The lumps are pressed through the screen openings by means of a black rubber stopper. The moist granules are received in the sieve pan.

In a fourth step, the granules from the third step are further dried overnight at room temperature. A free-flowing offwhite colored product, identified as product No. 235, is obtained.

Test results

The calculated composition and closed bomb test results of product 235 are presented in Table I. Table II lists the burning time of consolidated No. 235.

Conclusions

Consolidated No. 235 has a burn time of 5.50 seconds which is much slower than most of the compositions discussed in this invention Another noteworthy difference is that ammoniumcontaining product No. 235 burns under generation of much more smoke than compositions containing sodium, potassium or lithium hydroxide. However, product No. 235 performs much less energetically than No. 222 in the closed bomb test (46.6 milliseconds rise time and 41,800 psi/sec. pressure development rate).

EXAMPLE V (Process B)

In this example, a charcoal-free black powder type granular product is prepared essentially following the procedure as described in Example I, except that lithium hydroxide is used instead of sodium hydroxide.

Preparation

In a first step, phenolphthalein (7.8 grams), lithium hydroxide (1.11 grams) and ethanol (40 grams) are added to a glass beaker and stirred. The resulting mixture has a purple color and contains a white precipitate. Stirring is continued for 15 minutes and results in the formation of a deep violet solution. Next, the solution is poured into a stainless steel pan of eight inch diameter and the solution allowed to dry overnight at ambient conditions in a fume hood. Next, the residue in the pan is dried for 30 minutes at 95° C. in an oven and is then ground in a mortar. The ground product is brushed through a No. 200 ASTM sieve. The other two raw materials, potassium nitrate and sulfur, are separately ground and brushed through the 200 mesh sieve before use.

In a second step, the three powders from step I, are added to a mortar of 3.5 inch diameter and dry mixed. The individual amounts are: phenolphthalein dilithium salt (3.56 grams), potassium nitrate (18.35 grams) and sulfur (2.43 grams). Next, a VAAR solution (11.4 grams of solution containing 0.24 gram solids), is added to the mortar and mixed with the powder. Mixing is continued and ethanol is allowed to evaporate from the mixture until the solution turns into soft lumps.

In a third step, the lumps from the second step are placed on a stainless steel No. 16 ASTM sieve of eight inch diameter positioned on a sieve pan of the same diameter. The lumps are pressed through the screen with a black rubber stopper. The moist granules are received in the sieve pan. In a fourth step. the granules from the third step are further dried overnight at room temperature. A free-flowing purple colored product, identified as product 236, is obtained.

Test results

The calculated composition and closed bomb test results of No. 236 are presented in Table I. Table II shows the burning time of consolidated No. 236.

Conclusions

Consolidated product 236 has a burn time of 3.70 seconds which is similar to that measured for most of the compositions prepared. Consolidated product 236 burns clean without much smoke generation.

Granular No. 236 has a rise time of 15.1 milliseconds and a pressure development rate of 138,000 psi/sec. in the closed bomb test. These values are similar to those of product 239. The size reduction test, carried out as described in Example II, shows that the ground product is much less energetic.

EXAMPLE VI (Process B)

In this example, a charcoal-free black powder type granular product is prepared according to a modification of Example V whereby pre-formed sodium salt of phenolphthalein is used and VITON binder in lieu of VAAR.

Preparation

In a first step, phenolphthalein (32.228 grams), water (100 ml) and sodium hydroxide (8.10 grams) are added to a 900 ml glass beaker and mixed. The solution is brought to boil on a hot plate and is then poured into a stainless steel pan. The solution is heated to dryness in an oven at 90° C. The residue, consisting of the disodium salt of phenolphthalein, is ground in a mortar and then screened through a 16 mesh screen.

In a second step the following powders are weighed out in a beaker: disodium salt of phenolphthalein (−16 mesh; 4.446 grams); potassium nitrate (−200 mesh; 23.994 grams); and sulfur flour (3.016 grams). The powders are mixed and the mixture is transferred to a mortar. A VITON solution (0.321 gram of VITON dissolved in 4.389 grams of methyl ethyl ketone and 15.00 grams of ethanol) is mixed with the powder using a pestle. Mixing is continued allowing the solvents to evaporated from the mixture until soft lumps are formed.

In a third step, the lumps from the second step are placed on a stainless steel No. 16 ASTM sieve of eight inch diameter fitted on a sieve pan. The lumps are pressed through the sieve openings using a black rubber stopper. The granules are received in the pan.

In a fourth step the moist granules are dried overnight at room temperature. A free flowing violet colored product, identified as No. 240, is obtained.

Test results

The calculated composition and closed bomb test results of product 240 are presented in Table I. Table II shows the burning time of consolidated 240.

Conclusions

Consolidated product 240 has a burn time of 6.90 seconds which is almost 50% slower than for most of the compositions. This may be the result of the VITON coating.

Granular 240 had a rise time of 14.8 milliseconds and a pressure development rate of 120,000 psi/sec. in the closed bomb test. These values are similar to that of No. 239.

EXAMPLE VII (Process B)

In this example, a charcoal-free black powder substitute was prepared following a modification of Example V whereby pre-formed disodium salt of phenolphthalein is used as a reagent and VITON A as a binder in place of VAAR.

Preparation

In a first step, phenolphthalein disodium salt (prepared as under Example VI; 7.143 grams), potassium nitrate (25.000 grams) and sulfur (3.572 grams) are mixed in a 900 ml glass beaker and the powder mixture is added to mortar of 3.5 inch diameter by 2 inches depth.

In a second step a VITON A solution (0.397 gram of VITON A dissolved in 3.613 grams of methyl ethyl ketone and 15.00 grams of ethanol) is added to the mortar and mixed using a pestle. Mixing is continued allowing the solvents to evaporate from the mixture until soft lumps are formed.

In a third step, the lumps from the second step are placed on a stainless steel No. 16 ASTM sieve of eight inch diameter fitted on a sieve pan. The lumps are pressed through the sieve openings using a black rubber stopper. The granules are received in the pan.

In a fourth step, the moist granules are dried overnight at room temperature. A free-flowing violet colored product, identified as No. 241, is obtained.

Test results

The calculated composition and closed bomb test results of No. 241 are presented in Table I. Table II shows the burning time of consolidated 241.

Conclusions

Consolidated 241 could not be ignited. This is apparently the result of the VITON A coating. Granular 241 has a rise time of 78.3 milliseconds and a pressure development rate of 18,400 psi/sec. in the closed bomb test. These values are relatively low and may be caused by an inhibiting effect of VITON A.

EXAMPLE VIII (Process C)

In this example, a charcoal-free black powder substitute is prepared following a modification of Process A by omitting the addition of a binder and by using aqueous ethanol to dissolve potassium hydroxide. The molar ratio of phenolphthalein to potassium hydroxide was 0.406.

Preparation

In a first step, phenolphthalein (6.990 grams), potassium nitrate (26.800 grams) and sulfur (4.200 grams) are dry mixed with a spatula in a plastic cup. The powder mixture is added to a porcelain dish of 8 inch diameter.

In a second step, potassium hydroxide solution (5.0 grams of solution consisting of 0.5 grams of potassium hydroxide and 4.5 grams of aqueous ethanol containing 10% wt. of water) is added to the dish and the dispersion mixed with a pestle. An additional amount of 10.0 grams ethanol is added to the dish and mixed. Mixing is continued allowing ethanol to evaporate from the mixture until soft lumps are formed.

In a third step, the lumps from the second step are placed on a stainless steel No. 12 ASTM sieve of eight inch diameter fitted on a sieve pan. The lumps are pressed through the sieve openings using a black rubber stopper. The granules are received in the pan.

In a fourth step the moist granules are dried for one hour at 70° C. A free-flowing violet colored product, identified as No. 53, is obtained.

Test results

The calculated composition and closed bomb test results of #53 are presented in Table I.

Conclusions

Granular No. 53 has a rise time of 12.9 milliseconds and a pressure development rate of 111,200 psi/sec. in the closed bomb test. These values are relatively high in the series tested.

EXAMPLE IX (Process C)

In this example, a charcoal-free black powder substitute is prepared following a modification of Process A by omitting the addition of a binder and by using aqueous ethanol to dissolve potassium hydroxide. The molar ratio of phenolphthalein to potassium hydroxide was 1.75.

Preparation

In a first step, phenolphthalein (6.990 grams), potassium nitrate (32.85 grams) and sulfur (5.150 grams) are dry mixed in a plastic cup. The powder mixture is added to a porcelain dish of 8 inch diameter.

In a second step potassium hydroxide solution (21.57 grams of solution consisting of 10% wt. potassium hydroxide, 10% wt. water and 80% wt. ethanol) is added to the dish and the dispersion is mixed using a pestle. Mixing is continued allowing ethanol to evaporate from the mixture until soft lumps are formed.

In a third step, the lumps from the second step are placed on a stainless steel No. 12 ASTM sieve of eight inch diameter fitted on a sieve pan. The lumps are pressed through the sieve openings using a black rubber stopper. The granules are received in the pan.

In a fourth step, the moist granules are dried for one hour and fifteen minutes at 100° C. A free-flowing violet colored product, identified as No. 54 is obtained.

Test results

The calculated composition and closed bomb test results of product No. 54 are presented in Table I.

Conclusion

Granular product No. 54 has a rise time of 7.6 milliseconds and a pressure development rate of 179,000 psi/sec. in the closed bomb test. These values are the best in the series tested.

EXAMPLE X (Process C)

In this example, a charcoal-free black powder substitute is prepared as a baseline in which water is used as the mixing medium instead of ethanol and no potassium hydroxide is added. The granular composition is therefore a mixture of phenolphthalein, potassium nitrate and sulfur.

Preparation

In a first step, phenolphthalein (6.990 grams), potassium nitrate (32.85 grams) and sulfur (5.150 grams) are dry mixed in a plastic cup. The powder mixture is added to a porcelain dish of 8 inch diameter.

In a second step 25 grams of water is added to the dish and the dispersion mixed using a pestle. Mixing is continued until sufficient water has evaporated from the mixture and soft lumps are formed.

In a third step, the lumps from the second step are placed on a stainless steel No. 12 ASTM sieve of eight inch diameter fitted on a sieve pan. The lumps are pressed through the sieve openings using a black rubber stopper. The granules are received in the pan.

In a fourth step, the moist granules are dried for one hour at 100° C. A free flowing white product, identified as No.55 is obtained.

Test results

The calculated composition and closed bomb teat results of product No. 55 are presented in Table I.

Conclusions

Granular No. 55 has a rise time of 46.2 milliseconds and a pressure development rate of 26,000 psi/sec. in the closed bomb test. These values are low in the series tested.

While the invention has been explained in relation to its preferred embodiment, it is to be understood that various modifications thereof will become apparent to those skilled in the art upon reading the specification and is intended to cover such modifications as fall within the scope of the appended claims.

TABLE I

| | BLACK POWDER TYPE COMPOSITION (% WT) | | | | | | | | CLOSED BOMB TEST RESULTS | |
|---|---|---|---|---|---|---|---|---|---|---|
| | ALKALI-METAL HYDROXIDE | | | | | BINDER | | | | |
| PRODUCT NO.: | % | FORMULA | KNO3 | SULFUR | PHENOLPHTHALEIN | % | TYPE | PROCESS | RISE TIME (SECONDS) | PRESSURE DEVPT. RATE (PSI/SEC) |
| BP, GOEX, CLASS V | | | | | | | | | 0.0126 | 155,000 |
| BP, GOEX, CLASS V, GROUND | | | | | | | | | 0.0093 | 215,000 |
| BP, GOEX, CLASS III | | | | | | | | | 0.0205 | 91,800 |
| BP, CIL, CLASS I | | | | | | | | | 0.0176 | 80,200 |
| 221 | 3.0 | NaOH | 73.3 | 9.8 | 12.7 | 1.2 | VAAR | A | 0.0660 | 15,900 |
| 222 | 4.5 | KOH | 69.4 | 10.9 | 14.8 | 0.4 | VAAR | A | 0.0103 | 178,000 |
| 222-Ground | 4.5 | KOH | 69.4 | 10.9 | 14.8 | 0.4 | VAAR | A | 0.0218 | 89,200 |
| 239 | 2.9 | NaOH | 74.6 | 9.4 | 12.1 | 1.0 | DUREZ | A | 0.0140 | 126,000 |
| 239-Ground | 2.9 | NaOH | 74.6 | 9.4 | 12.1 | 1.0 | DUREZ | A | 0.0353 | 42,300 |
| 235 | 1.5 | NH4OH | 73.3 | 9.8 | 14.2 | 1.0 | VAAR | B | 0.0466 | 41,800 |
| 236 | 1.8 | LIOH | 74.7 | 9.9 | 12.7 | 1.0 | VAAR | B | 0.0151 | 138,000 |
| 236-Ground | 1.8 | LIOH | 74.7 | 9.9 | 12.7 | 1.0 | VAAR | B | 0.0243 | 69,800 |
| 240 | 1.7 | NaOH | 75.5 | 9.5 | 12.3 | 1.1 | VITON | B | 0.0148 | 120,000 |
| 241 | 2.5 | NaOH | 69.2 | 9.9 | 17.3 | 1.1 | VITON A | B | 0.0783 | 18,400 |
| 53 | 1.3 | 1.3 | 69.6 | 10.9 | 18.2 | 0.0 | none | C | 0.0129 | 111,200 |
| 53 (3 days @ 80% R.H.) | " | " | " | " | " | " | " | " | 0.0174 | 77,600 |
| 54 | 4.6 | 4.6 | 69.7 | 10.9 | 14.8 | 0.0 | none | C | 0.0076 | 179,000 |
| 54 (3 days @ 80% R.H.) | " | " | " | " | " | " | " | " | 0.0212 | 58,700 |
| 55 | 0.0 | — | 73.0 | 11.4 | 15.6 | 0.0 | none | C | 0.0462 | 26.300 |
| 55 (3 days @ 80% R.H.) | " | " | " | " | " | " | " | " | 0.0452 | 24,900 |

TABLE II

| PRODUCT NO.: | ALKALI METAL HYDROXIDE FORMULA | % | BLACK POWDER TYPE COMPOSITIONS $KNO_3$ | SULFUR | CHARCOAL | PHENOLPHTHALEIN | BINDER % | BINDER TYPE | PROCESS | BURN CHARACTERISTICS AFTER CONSOLIDATION TIME (seconds) | |
|---|---|---|---|---|---|---|---|---|---|---|---|
| BP, CLASS III | — | 0.0 | 75.0 | 10.0 | 15.0 | — | — | — | | 2.06 | DIRTY |
| 218 | NaOH | 3.0 | 73.8 | 9.8 | none | 12.8 | 0.6 | VAAR | A | 3.49 | |
| 219 | NaOH | 3.4 | 70.4 | 10.9 | none | 14.9 | 0.4 | VAAR | A | 3.94 | |
| 220 | none | — | 72.8 | 11.4 | none | 15.4 | 0.4 | VAAR | A | No Ingition | |
| 221 | NaOH | 3.0 | 73.3 | 9.8 | none | 12.7 | 1.2 | VAAR | A | 3.44 | |
| 222 | KOH | 4.5 | 69.4 | 10.9 | none | 14.8 | 0.4 | VAAR | A | 3.75 | |
| 233 | NaOH | 2.6 | 78.7 | 8.5 | none | 11.1 | 1.1 | PVA | B | 3.80 | |
| 234 | NaOH | 2.5 | 73.7 | 9.9 | none | 12.9 | 0.5 | PVA | A | 3.80 | |
| 235 | $NH_4OH$ | 1.5 | 73.3 | 9.8 | none | 14.2 | 1.0 | VAAR | B | 5.50 | DIRTY |
| 236 | LIOH | 1.8 | 74.7 | 9.9 | none | 12.7 | 1.0 | VAAR | B | 3.70 | |
| 239 | NaOH | 2.9 | 74.6 | 9.4 | none | 12.1 | 1.0 | DUREZ | A | 3.45 | |
| 240 | NaOH | 1.7 | 75.5 | 9.5 | none | 12.3 | 1.1 | VITON | B | 6.90 | |
| 241 | NaOH | 2.5 | 69.2 | 9.9 | none | 17.3 | 1.1 | VITON A | B | No Ignition | |

What is claimed is:

1. A method of producing an energetic composition comprising the steps of:

(a) dissolving an alkali metal hydroxide in a solvent selected from the group consisting of water, ethanol, denatured alcohol and mixtures thereof to form an alkali metal hydroxide solution;

(b) kneading the reaction product of a phenolic compound and phthalic anhydride with sulfur, an alkali metal nitrate selected from potassium nitrate and sodium nitrate and said alkali metal hydroxide solution formed in step (a);

(c) allowing the kneaded product formed in step (b) to dry through evaporation of the solvent used in step (a);

(d) granulating the dried product formed in step (c); and (e) further drying the granulated product formed in step (d).

2. The method of claim 1 wherein the solvent is denatured alcohol containing water.

3. The method of claim 1 wherein the alkali metal hydroxide used in step (a) is selected from the group consisting of sodium hydroxide, potassium hydroxide, lithium hydroxide, rubidium hydroxide, cesium hydroxide, francium hydroxide and ammonium hydroxide.

4. The method of claim 1 wherein the reaction product of a phenolic compound and phthalic anhydride is phenolphthalein.

5. The method of claim 1 wherein in step (b) the reaction product of a phenolic compound and phthalic anhydride is first mixed with the sulfur and potassium nitrate after which the resulting mixture is mixed with the alkali metal hydroxide solution formed in step (a).

6. The method of claim 5 wherein in step (b) the reaction product of a phenolic compound and phthalic anhydride, sulfur and alkali metal nitrate are used, respectively, in the relative amounts of about 15, about 10, and about 75 parts by weight.

7. The method of claim 2 wherein the aqueous denatured alcohol solution contains less than about 10 weight percent water.

8. The method of claim 7 wherein in step (a) the aqueous alcohol solution and alkali hydroxide are used, respectively, in the relative amounts of about 25 and about 5 parts by weight.

9. A method of producing an energetic composition comprising the steps of:

(a) kneading an alkali metal salt of a reaction product of a phenolic compound and phthalic anhydride with sulfur, an alkali metal nitrate selected from potassium nitrate and sodium nitrate and a solvent selected from the group consisting of water, ethanol, denatured alcohol and mixtures thereof;

(b) allowing the kneaded product formed in step (c) to dry through evaporation of the solvent used in step (a);

(c) granulating the dried product formed in step (b); and (d) further drying the granulated product formed in step (c).

10. The method of claim 9 wherein the solvent is denatured alcohol containing water.

11. The method of claim 9 wherein the reaction product of a phenolic compound and phthalic anhydride is phenolphthalein.

12. The method of claim 9 wherein the salt of the reaction product of a phenolic compound and phthalic anhydride is selected from the group consisting of salts of sodium, potassium, lithium, ammonium and mixtures thereof.

13. The method of claim 12 wherein the salt of the reaction product of a phenolic compound and phthalic anhydride is a potassium salt.

14. An energetic composition produced by the method comprising the steps of:

(a) dissolving an alkali metal hydroxide in a solvent selected from the group consisting of water, ethanol, denatured alcohol and mixtures thereof to form an alkali metal hydroxide solution;

(b) kneading the reaction product of a phenolic compound and phthalic anhydride with sulfur, an alkali metal nitrate selected from potassium nitrate and sodium nitrate and said alkali metal hydroxide solution formed in step (a);

(c) allowing the kneaded product formed in step (b) to dry through evaporation of the solvent used in step (a);

(d) granulating the dried product formed in step (c); and (e) further drying the granulated product formed in step (d).

15. The composition of claim 14 wherein the solvent is denatured alcohol containing water.

16. The composition of claim 14 wherein the alkali metal hydroxide used in step (a) is selected from the group consisting of sodium hydroxide, potassium hydroxide, lithium hydroxide, rubidium hydroxide, cesium hydroxide, francium hydroxide and ammonium hydroxide.

17. The composition of claim 14 wherein the reaction product of a phenolic compound and phthalic anhydride is phenolphthalein.

18. The composition of claim 14 wherein in step (b) the reaction product of a phenolic compound and phthalic anhydride is first mixed with the sulfur and potassium nitrate after which the resulting mixture is mixed with the alkali metal hydroxide solution formed in step (a).

19. The composition of claim 18 wherein in step (b) the reaction product of a phenolic compound and phthalic anhydride, sulfur and alkali metal nitrate are used, respectively, in the relative amounts of about 15, about 10, and about 75 parts by weight.

20. The method of claim 15 wherein the aqueous denatured alcohol solution contains less than about 10 weight percent water.

21. The method of claim 20 wherein in step (a) the aqueous alcohol solution and alkali hydroxide are used, respectively, in the relative amounts of about 25 and about 5 parts by weight.

22. An energetic composition produced by the method comprising the steps of:

(a) kneading an alkali metal salt of a reaction product of a phenolic compound and phthalic anhydride with sulfur, an alkali metal nitrate selected from potassium nitrate and sodium nitrate and a solvent selected from the group consisting of water, ethanol, denatured alcohol and mixtures thereof;

(b) allowing the kneaded product formed in step (c) to dry through evaporation of the solvent used in step (a);

(c) granulating the dried product formed in step (b); and (d) further drying the granulated product formed in step (c).

23. The composition of claim 22 wherein the solvent is denatured alcohol containing water.

24. The composition of claim 22 wherein the reaction product of a phenolic compound and phthalic anhydride is phenolphthalein.

25. The composition of claim 22 wherein the salt of the reaction product of a phenolic compound and phthalic anhydride is selected from the group consisting of salts of sodium, potassium, lithium, ammonium and mixtures thereof.

26. The composition of claim 25 wherein the salt of the reaction product of a phenolic compound and phthalic anhydride is a potassium salt.

* * * * *